United States Patent [19]

Semel

[11] 4,065,331

[45] Dec. 27, 1977

[54] ROLLED LOW CARBON NIOBIUM STEEL

[75] Inventor: Frederick J. Semel, Philadelphia, Pa.

[73] Assignee: Alan Wood Steel Company, Conshohocken, Pa.

[21] Appl. No.: 730,937

[22] Filed: Oct. 8, 1976

[51] Int. Cl.[2] ..... C22C 38/06; C22C 38/16

[52] U.S. Cl. ..... 148/36; 75/124; 75/125; 148/12 F

[58] Field of Search ..... 75/124, 125, 123 J, 75/123 K, 123 B; 148/36, 12 F

[56] References Cited

U.S. PATENT DOCUMENTS

| | | | |
|---|---|---|---|
| 3,310,441 | 3/1967 | Mandich | 148/36 |
| 3,328,211 | 6/1967 | Nakamura | 75/125 |
| 3,592,633 | 7/1971 | Osuka et al. | 75/125 |

*Primary Examiner*—Arthur J. Steiner

*Attorney, Agent, or Firm*—Jackson, Jackson & Chovanes

[57] ABSTRACT

This is a process and product in which excellent properties are achieved with a relatively low alloy steel and normal rolling with a steel having the following composition in addition to iron and impurities, in percentages by weight:

| | |
|---|---|
| Carbon | .05 to .12 |
| Manganese | .25 to .90 |
| Silicon | .15 to .50 |
| Nickel | .15 to .50 |
| Copper | .15 to .50 |
| Aluminum | .02 to .110 |
| Niobium (Columbium) | .07 to .140 |
| Nitrogen | .007 to .015 |
| Phosphorus | .010 maximum |
| Sulfur | .025 maximum. |

2 Claims, No Drawings

ROLLED LOW CARBON NIOBIUM STEEL

DESCRIPTION

This invention relates to a special low carbon niobium steel and process.

I understand that J. M. Gray of the Molybdenum Corporation of America, in tests whose public report, if any, I do not know, has shown that it is possible to achieve an excellent combination of high strength and low temperature impact resistance in as-rolled heavy gauge plate using normal rolling and finishing conditions with steel of the following composition:

| %C | %Mn | %Cb | %ce / %S |
|---|---|---|---|
| .03 to .04 | 1.60 to 1.90 | .14 to .21 | $\frac{1}{2}$ |

For example, ½-inch gauge plates finish rolled at 1800° F (1000° C) follows:

| Yield Stg. Psi (kg/mm²) | Tensile Stg. Psi (kg/mm²) | 40 ft-bl (5.6 Kgm) Transition Temp. ° F (° C) |
|---|---|---|
| 65,000 to 75,000 (46.0 to 53.0) | 75,000 to 95,000 (53.0 to 67.0) | −60 to −150 (−50 to −100) |

These steels had exceptionally fine grain sizes in the neighborhood of ASTM 12.5. Gray attributed the properties primarily to the grain size and was of the opinion that the grain size was in turn an effect of the steels' high niobium contents. He believed that the high niobium promoted the precipitation of CbC (not CbN) during rolling at temperatures as high as 1900° to 2000° F (1050°–1100° C). This had the effect of inhibiting recrystallization and grain growth and thus of producing an unusually fine austenitic grain size which was eventually inherited by the ferrite.

Probably, Gray's theory of the properties and grain size is in essence correct. However, it is far from obvious that his alloy composition offers any economic advantage over controlled rolling or that it is even practical in view of the difficulties which the high niobium and manganese is likely to cause during welding. Thus, in short, Gray has an interesting concept of doubtful practical value.

I have done work to develop a steel which could be rolled using normal rolling procedures to gauges of ½ inch (12.5 mm) and heavier and which would exhibit properties comparable to those which are presently attainable only by controlled rolling. The properties sought were as follows:

| Yield Stg. Psi (kg/mm²) | Tensile Stg. Psi (kg/mm²) | 20 ft-lb (2.8 kgm) CVN Transition Temp. (Charpy V-notch) ° F (° C) |
|---|---|---|
| 60/70,000 (42.0 to 49.0) | 70/80,000 (49.0 to 56.0) | −20° longitudinal (−29°) |

Preliminary Considerations

For this purpose, it is necessary to design a leaner alloy than Gray's which would have the same or preferably greater potential to precipitate a carbide during rolling. The precipitation reaction is $$Nb + C \rightarrow NbC \quad (1)$$

The extent to which this reaction occurs under any set of conditions is determined by two broad classes of phenomena: Thermodynamics and Kinetics.

Thermodynamics

In order for NbC to precipitate, thermodynamics requires that the product of the chemical activities $a_c$ and $a_{nb}$ of the constituent elements, carbon and niobium, exceed the solubility product constant $K_a$ of the carbide at the particular temperature T at which the reaction is expected to occur. Mathematically, the condition for precipitation, therefore, is $$[a_c]\,[a_{nb}] \geqq Ka(T) \quad (2)$$

where the notation $Ka(T)$ denotes that $Ka$ is a function of $T$.

The activity of an element in solution is proportional to its concentration C according to the relation $$a = \gamma_c \quad (3)$$

where $\gamma$, the proportionality factor, is called the activity coefficient. Thus, equation (2) may be rewritten as $$[\gamma_c C_c]\,[\gamma_{nb} C_{nb}] = [\gamma_c \cdot \gamma_{nb}]\,[C_c]\,[C_{nb}] \geqq Ka(t) \quad (4)$$

In dilute solution such as low alloy steel, it is usually found that the activity coefficient of a given element is a constant independent of the concentration of the element itself, (Henry's law). However, its value may be effected by the concentrations of the other elements present, that is, there may be so-called interaction effects. An important peculiarity of interaction effects in regard to precipitates is that while a change in the concentration of any one of the elements which go to form the precipitate may affect the activity coefficients of the other elements involved and vice versa, the value of the activity coefficient term in the solubility product formula remains uncharged. Thus, equation (4) may be rewritten as $$[C_c]\,[C_{cb}] \geqq \frac{Ka(T)}{[\gamma_c \cdot \gamma_{nb}]} \quad (5)$$

It is seldom if ever that solubility data are presented in terms of the various thermodynamic quantities contained in the quotient on the right hand side of equation (5). Instead, one typically sees the well-known empirical. relation $$[C_c]\,[C_{nb}] \geqq Kc(T) \quad (6)$$

where $Kc(T)$ is the so-called "concentration solubility product constant."

Comparing equations (5) and (6), it will be evident that $$Kc(t) = \frac{Ka(T)}{[\gamma_c \cdot \gamma_{nb}]} \quad (7)$$

This relation is important because while it shows that $Kc$ is indeed a constant, it also shows that it is only so in a rather narrow sense. For example, at a specified temperature $Ka$ is a true constant completely independent of composition. However, the product $[\gamma c \cdot \gamma_{nb}]$ is constant only insofar as carbon and niobium are concerned.

Otherwise, it is not a constant, being subject to change in accordance with the interaction effects of the other elements which are present. Thus, in view of equation (7), it will be evident that while *Kc* can be expected to be constant in a particular alloy, its value will in general vary from one alloy to another. Note significantly, it will also be evident that this means that independently of carbon and niobium the tendency for niobium carbide to precipitate is to some extent amenable to alloy content.

To make use of this fact quantitatively, it is necessary to know the interaction effects of the various common alloying elements on both carbon and niobium. Unfortunately, at the time this particular subject matter was first gone into, data were not available to me on the effects of the various elements on niobium. However, data were available on the effects of Mn, Mo, Cr, Ni, Cu, Si, V and Al on carbon. Accordingly, based on these findings, it would be excpected that Mn, Mo, Cr and V would decrease the tendency of the carbide to precipitate whereas Ni, Cu, Si and Al would have the opposite effect. Thus, although this is admittedly qualitative, it was decided to design the alloy on the basis of these indications; that is, to design it with relatively high Ni, Cu, Si, and Al contents and with low or negligible Mn, Mo, Cr, and V contents. So far as is known, this is a novel concept.

For chiefly metallurgical reasons, it was decided that the carbon content should be in the range of 0.07 to 0.11%. To decide the all important niobium content, thermodynamic and kinetic considerations were each employed. Thermodynamically, it was considered that the potential of the alloy to precipitate the carbide, as determined independently of interaction effects, should be at least as great as that of the alloys studied by Gray. The product $[C_c]$ $[C_{nb}]$ was taken as a measure of the precipitation potential. In Gray's alloys, the value of this product varied from 0.0042 to 0.0082; an average being 0.0062. Thus, using this value and the aforementioned limits on carbon, the niobium range was tentatively fixed at 0.055 to 0.090%.

According to Mori, et al., in TETSU TO HAGANE, Vol. 54, 1968, page 763, the solubility product constant of niobium carbide, independent of interaction effects, varies with temperature as follows:

$$\log_{10}[C_c]\,[C_{nb}] = -7700/T(K^\circ) + 3.18 \qquad (8)$$

Inserting the aforementioned value of 0.0062 for the product $[C_c]$ $[C_{nb}]$ it is found that austenite containing carbon and niobium in the indicated ranges will on the average first become saturated with the carbide at a temperature of 2110° F (1155° C). In other words, considering only the effects of carbon and niobium, 2110° F (1155° C), is the thermodynamic or equilibrium "precipitation start temperature."

Kinetics

As far as known, quantitative data on the kinetics of niobium carbide precipitation in austenite at the temperatures of interest do not exist. However, based on general knowledge of such phenomena, additional deductions affecting composition were made.

In the solid state, the kinetics of precipitation are dependent upon nucleation and growth phenomena. These phenomena, being thermally activated, are in turn dependent primarily on temperature. Thus, to decide which if either of the two processes is likely to have the greater effect, it is necessary first to estimate the temperature range in which the precipitation reaction is expected to occur.

Accordingly, the finishing temperatures anticipated in the rolling of ½ inch (12.5 mm) and heavier gauge plates are in the range of 1800° to 2000° F (1000° to 1100° C). Thus, if carbide is to have any effect in preventing recrystallization and grain growth during rolling, it is apparent that its precipitation must occur at somewhat higher temperatures, say for the sake of discussion, in the range of 2000° to 2100° F (1100° to 1150° C).

Compared to the previously determined value for the precipitation start temperature of 2110° F (1155° C), the range 2000° to 2100° F (1100° to 1150° C) is obviously high. Thus according to the usual conceptions of precipitation in condensed systems, nucleation rather than growth would be expected to be the rate controlling process.

In general, three factors contribute to the activation barrier to nucleation. These include the strain, interfacial, and volume free energy changes associated with the precipitate and/or the precipitation reaction. Other than the volume free energy which is affected by composition in identically the same way as the concentration solubility product constant, it is ordinarily very difficult, especially in the solid state, to influence these other factors to any appreciable extent either by composition or processing. Significantly, however, this may not be true in the present case. To be specific, it may be possible to use niobium nitride as seed nuclei for the carbide. Theoretically, this should reduce the activation barriers which the strain and interfacial energies would otherwise pose to the carbide and thereby catalyze its precipitation.

There are two facts which suggested this possibility. One is that the nitride and carbide are mutually miscible in all proportions in the solid state. Thus, either could serve as nucleus for the other. Second is the fact that the nitride is significantly more stable than the carbide. Indeed, it is so much more stable that even when present in concentrations as much as an order of magnitude smaller, its precipitation start temperature is substantially higher than that of the carbide. For example, Mori et al. on page 763 of TETSU TO HAGANE, Vol. 54, 1968 give for the temperature variation of the solubility product constant of the nitride the relation $$\log_{10}[C_n]\,[C_{nb}] = -10{,}150/T(K^\circ) + 3.79. \qquad (9)$$

Inserting the value 0.00062 for the product $[C_n] \times [C_{nb}]$ in this relation yields a precipitation start temperature for the nitride of 2150° F (1175° C). The value of 0.00062 may be compared to the value of 0.0062 used in the case of the carbide. By combining the value 0.00062 with the previously mentioned niobium range of 0.055 to 0.090%, it can be shown that the nitrogen range corresponding to the indicated start temperature is 0.007 to 0.011%. (The fact that this range happens to be very nearly equal to the residual nitrogen range which is typically encountered in low carbon BOF made steels is purely coincidental.)

The precipitation of the nitride is, of course, subject to the same constraints in regard to kinetics as is that of the carbide. Thus, while the nitride start temperature of 2150° F (1175° C) is higher than that of the carbide, it will be evident that it should probably be higher still, say at least 2200° F (1200° C), if it is to have the desired effect of seeding the carbide in the range of 2000° to 2100° F (1100° to 1150° C).

To increase the nitride precipitation start temperature, it is only necessary to increase the content of either the nitrogen or the niobium or both. Purely as a practical matter, the proper choice at this point would have been to increase the nitrogen. However, it was instead decided to increase the niobium. The reason for this was that such an increase would also effect an increase in the carbide start temperature and thus, in some measure, serve to hedge against the possibibility that the nitride seeding idea was incorrect.

Using equation (9), it was determined that an average increase in niobium of 0.02% would increase the nitride precipitation start temperature to 2212° F (1210° C). Thus, in accordance with this finding, the niobium range was finally theorized at 0.075 to 0.110%.

However, it is considered that as a practical matter, the range and preferred range given elsewhere here are properly usable as such.

Combining the results of these and other considerations, the steel of my invention has a composition which, in addition to iron and impurities beyond those mentioned below, is within the following limits, in percentages by weight:

| | |
|---|---|
| Carbon | .05 to .12 |
| Manganese | .25 to .90 |
| Silicon | .15 to .50 |
| Copper | .15 to .40 |
| Aluminum | .02 to .110 |
| Niobium (Columbium) | .07 to .140 |
| Nitrogen | .007 to .015 |
| Phosphorus | .010 maximum |
| Sulphur | .025 maximum. |

I do not provide in my steel for any chromium, molybdenum or vanadium, to mention three other commonly used alloying elements.

Preferably, my steel will have a composition, in addition to iron and impurities beyond those mentioned below, which is within the following limits, in percentages by weight:

| | |
|---|---|
| Carbon | .07 to .11 |
| Manganese | .40 to .60 |
| Silicon | .30 to .40 |
| Nickel | .20 to .30 |
| Copper | .20 to .30 |
| Aluminum | .08 to .10 |
| Niobium | .07 to .12 |
| Nitrogen | .008 to .011 |
| Phosphorus | .010 to .011 |
| Sulphur | .025 maximum. |

EXPERIMENTAL

To test these indications, two platemill ingots, A and B, were modified by mold additions to a heat of the regular A.W. 0440 (Alan Wood 0440) grade of steel. Their compositions are shown below. Shown also is the composition of steel C corresponding to an unmodified platemill ingot of the regular 0440 grade but from an earlier heat than that used in the manufacture of steels A and B. The compositions are in percentages by weight.

| Steel | C | Mn | P | S | Si | Ni | Cr | Cu | Mo | Al | Nb | V | N |
|---|---|---|---|---|---|---|---|---|---|---|---|---|---|
| A | .11 | .91 | .007 | .013 | .26 | .02 | .02 | .09 | .004 | .107 | .085 | nil | .0051 |
| B | .09 | .85 | .006 | .013 | .49 | .23 | .02 | :29 | .004 | .100 | .120 | nil | .0080 |
| C | .08 | .73 | .009 | .020 | .25 | .03 | .03 | .07 | .005 | .055 | .055 | nil | .0056 |

Steel A

Steel A and, for that matter, Steel B each have a higher manganese content than was specified in the desired composition. This, of course, is a consequence of having used the 0440 grade as the base steel.

In other respects, Steel A has increased carbon, aluminum, and niobium contents relative to the base steel as represented by Steel C. The increases in carbon and columbium were intentional. The increased aluminum, however, was not. The objective of the increased carbon and columbium contents was to increase the carbide start temperature so as to test the influence of this factor independently of other factors such as the nitride start temperature and/or interaction effects. According to equations (8) and (9), the carbide and nitride start temperatures of Steel A are 2195° F and 2100° F respectively (1202° C and 1150° C respectively).

Steel B

Relative to Steel A, Steel B has a lower carbon content and relative to both Steels A and C, it has increased silicon, nickel, copper, columbium, and nitrogen contents. With the exception of nitrogen, these various differences were all intentional. The primary objective of Steel B was to test the indications in regard to the interaction effects of silicon, nickel, and copper. A secondary objective was to alter the carbon-columbium stoichiometry from that of Steel A. To do this and yet maintain the same carbide start temperature as in Steel A, it was necessary to decrease the carbon and increase the niobium, each by the same amount. As it actually turned out, the increase in the niobium, due to a better recovery than anticipated, exceeded the decrease in carbon by 0.015%. Thus, independently of interaction effects, Steel B ended up with a slightly higher carbide start temperature than Steel A. It also had a higher nitride start temperature. For example, according to equations (8) and (9), its start temperatures are 2230° F (1220° C) for the carbide and 2225° F (1219° C) for the nitride.

Steel C

Steel C is in all respects typical of the regular 0440 grade of steel. For purposes of comparison, its carbide and nitride start temperatures are 2055° F (1124° C) and 2045° F (1118° C) respectively.

All three steels were cross-rolled to ½ inch × 84 inches × prod. (1.25 × 213 × prod [cm]) using entirely normal rolling procedures. The resulting mechanical properties and ferrite grain sizes of each are listed below.

| Steel | LYP ksi (kg/mm²) | UYP ksi (kg/mm²) | TS ksi (kg/mm²) | Elong. % in 2" (in 50mm) | 20 ft-lb (2.8 kgm) L-CVN TT ° F (° C) | G.S. ASTM |
|---|---|---|---|---|---|---|
| A | 60.4 | 65.5 | 74.7 | 27.5 | −30 | 10.1 |
| | (42.5) | (46.0) | (52.5) | (27.5) | −35) | (10.1) |
| B | 69.2 | 71.9 | 83.1 | 27.0 | −80 | 11.3 |
| | (48.7) | (50.6) | (58.4) | (27.0) | −63) | (11.3) |
| C | 56.0 | 60.0 | 70.5 | 28.5 | 0 | 7.9 |
| | (39.4) | (42.2) | (52.7) | (27.5) | (−18) | (7.9) |

In the above results:
LYP = lower yield point
UYP = upper yield point
TS = tensile strength
L-CVN TT = longitudinal Charpy V-notch transition temperature
GS = grain size
Ksi – thousands of pounds per square inch.

These results are fairly self explanatory. Steels A and B each exhibited significantly improved mechanical properties and grain sizes relative to Steel C with the greatest overall improvements occurring in Steel B.

Indications From the Above Experiments

1. It is possible to develop a reasonably low alloy steel having properties after normal rolling such as were heretofore thought to be attainable only by very high alloy content or controlled rolling.

2. While not unequivocal, the overwhelming superiority of Steel B as compared to Steel A strongly suggests that solute interaction effects do, as initially theorized, have considerable influence on carbide precipitation and that it is both possible and practical to exploit such effects by alloy design.

The steels of the present invention have an unusual combination of strength and toughness, together at the same time with economy resulting from the fact that no extraordinary processing of any kind is required, although a still more extraordinary combination of properties may be secured by use of special processing.

More specifically, the steels of the present invention involve a combination of at least 42.0 kilograms per square millimeter at room temperature in their lower yield point and a 2.8 kilogram meter Charpy V-notch transition temperature of no greater than −50° C, in the as-rolled condition without the need for special rolling conditions such as low finishing temperatures and large final reductions.

One of the advantages of the steel of the invention is that it enables increased productivity, by avoiding low finishing temperatures, which require long waits or delays in the mill at some point in the course of rolling.

In contrast to conventional steels with related purposes, my steel operates with normal rolling.

Furthermore, my steel has lower alloy content than Gray's steel, thus being much less expensive to manufacture, yet at the same time involving a sort of steel with superior weldability and better corrosion resistance as far as ordinary atmospheric environments are concerned.

Indeed, in connection with these advantages, the greater economy is an advantage which applies against existing steels for similar application as a whole, and the particular better corrosion resistance mentioned applies against a great many other steels.

Furthermore, the present steel, as compared to existing commercial steels for similar purposes has superior cold forming properties, as will be evident if for example comparison is made of it to ASTM A572 Grade A modified for application in electric transmission towers.

In view of my invention and disclosure, variations and modifications to meet individual whim or particular need will doubtless become evident to others skilled in the art to obtain all or part of the benefits of my invention without copying the process and structure shown, and I, therefore, claim all such insofar as they fall within the reasonable spirit and scope of my claims.

Having thus described my invention what I claim as new and desire to secure by Letters Patent is:

1. A steel in the as-rolled condition as a result of normal rolling practice having a lower yield point of at least 42.0 kilograms per square millimeter at room temperature, and a 2.8 kilogram meter Charpy V-notch transition temperature of no greater than −50° C, having a composition consisting essentially of the following, expressed in percentages by weight:

| | |
|---|---|
| Carbon | .07 to .11 |
| Manganese | .40 to .60 |
| Silicon | .30 to .40 |
| Nickel | .20 to .30 |
| Copper | .20 to .30 |
| Aluminum | .08 to .10 |
| Niobium | .07 to .12 |
| Nitrogen | .008 to .011 |
| Iron and impurities | Balance |

2. A steel in the as-rolled condition using normal rolling procedure and made up mainly of iron and consisting essentially also of the following in percentages by weight:

| | |
|---|---|
| Carbon | .05 to .12 |
| Manganese | .25 to .90 |
| Silicon | .15 to .50 |
| Nickel | .15 to .50 |
| Copper | .15 to .40 |
| Aluminum | .02 to .110 |
| Niobium | .07 to .140 |
| Nitrogen | .007 to .015. |

* * * * *

UNITED STATES PATENT OFFICE

CERTIFICATE OF CORRECTION

Patent No. 4,065,331 Dated Dec. 27, 1977

Inventor(s) Frederick J. Semel

It is certified that error appears in the above-identified patent and that said Letters Patent are hereby corrected as shown below:

Column 1, lines 15 and 16: change [ $\frac{\%ce}{\%S}$ ] to:

- $\frac{\%Ce}{\%S}$ -

Column 1, line 24: change [40 ft-bl] to - 40 ft-lb -

Column 2, line 23: change [$a = y_c$] to - $a = yC$ -

Column 2, line 67: change [ [$YC \cdot Y_{nb}$] ] to - [$Y_c \cdot Y_{nb}$]

Column 8, line 5: change [ -35) ] to - (-35) -

Column 8, line 7: change [ -63 ] to - (-63) -

Signed and Sealed this

Thirtieth Day of January 1979

[SEAL]

Attest:

RUTH C. MASON
Attesting Officer

DONALD W. BANNER
Commissioner of Patents and Trademarks